United States Patent [19]

Gustafson

[11] Patent Number: 5,033,297

[45] Date of Patent: Jul. 23, 1991

[54] SUBMERSIBLE SENSOR

[75] Inventor: Gregg S. Gustafson, Bothell, Wash.

[73] Assignee: Instrumentation Northwest, Inc., Redmond, Wash.

[21] Appl. No.: 444,849

[22] Filed: Dec. 4, 1989

[51] Int. Cl.[5] ..... E21B 47/00

[52] U.S. Cl. ..... 73/151; 73/155; 439/279; 439/589

[58] Field of Search ..... 73/151, 155; 174/52.1, 174/70 S; 439/279, 589, 624

[56] References Cited

U.S. PATENT DOCUMENTS

| | | | |
|---|---|---|---|
| 3,085,138 | 4/1963 | Brown et al. | 439/279 |
| 3,690,163 | 9/1972 | Shannon et al. | 73/151 |
| 4,193,655 | 3/1980 | Herrmann, Jr. | 439/589 |
| 4,682,832 | 7/1987 | Punako et al. | 439/589 |
| 4,828,509 | 5/1989 | Vogel | 439/587 |

FOREIGN PATENT DOCUMENTS

| | | | |
|---|---|---|---|
| 840574 | 7/1960 | United Kingdom | 174/70 S |

*Primary Examiner*—Hezron E. Williams
*Assistant Examiner*—Craig Miller
*Attorney, Agent, or Firm*—H. Albert Richardson

[57] ABSTRACT

A submersible sensor for use in monitoring the physical properties of well water or other fluids. The sensor includes a thin walled cylindrical body having a pair of opposing entrances, each of which has been machined to form a stepped counterbore. The sensor also includes a seal cone adapted to be inserted in either entrance and a seal disposed between the seal cone and the inner step of the counterbore.

11 Claims, 2 Drawing Sheets

SUBMERSIBLE SENSOR

BACKGROUND OF THE INVENTION

This invention generally relates to sensing devices and more particularly to a submersible sensor for use in monitoring the pressure temperature and other physical properties of well water or other fluids.

In the course of monitoring a water well it is frequently desirable to observe and record certain physical properties of the water in the well and the changes which occur in those characteristics over a period of time. The properties of interest usually include pressure, temperature, conductivity and pH level. Monitoring is normally accomplished with specialized sensors designed to be lowered into the well and submerged in the water. Typically, the sensors will include one or more sensing devices for detecting the fluid properties of interest such as a pressure transducer which is directly exposed to the fluid, signal conditioning means enclosed in a sealed housing and a multi-conductor cable for transmitting power to the sensor and signals from it.

The present invention incorporates these general design features and in addition includes a number of significant improvements which significantly reduce or eliminate certain problems found in other currently available submersible sensors. One such problem is the tendency of the sensors to leak in a high pressure environment. Another problem is that many of them are difficult to disassemble and repair. Further, because of their designs many of them are too large in diameter to be used in wells having common one inch diameter well casings.

Accordingly, it is an object of this invention to provide for an improved submersible sensor which is easier to assemble, disassemble and repair than those currently known.

It is another object of this invention to provide for a submersible sensor which is more resistant to leakage than those currently known.

It is another object of this invention to provide for a submersible sensor which can be assembled and disassembled without causing a twisting of the service cable.

SUMMARY OF THE INVENTION

This invention can be broadly summarized as providing for a submersible sensor for use in monitoring the physical properties of well water or other fluids. It includes a cylindrical body having a chamber and a cylindrical entrance to the chamber formed therein. A stepped counterbore located in the entrance has inner and outer steps with the inner step having a diameter less than that of the outer step. The sensor also includes a sensing means disposed within the chamber for sensing one or more physical properties of the fluid and a means for sealing the entrance. The sealing means includes a cone end insertable in the entrance and a seal disposed between the cone end and the inner step. Preferably, the seal is an o-ring.

The invention can also be summarized as a submersible sensor as described above and further including a second entrance also providing access to the chamber. Located in the second entrance is a second stepped counterbore having an outer step and an inner step with a radius less than that of the outer step. Further, the seal cone end is adapted to be interchangeably inserted in either entrance.

DESCRIPTION OF THE PREFERRED EMBODIMENT

The novel features believed to be characteristic of this invention are set forth in the appended claims. The invention itself, however, may be best understood and its various objects and advantages best appreciated by reference to the detailed description below in connection with the accompanying drawings.

Figure 1:
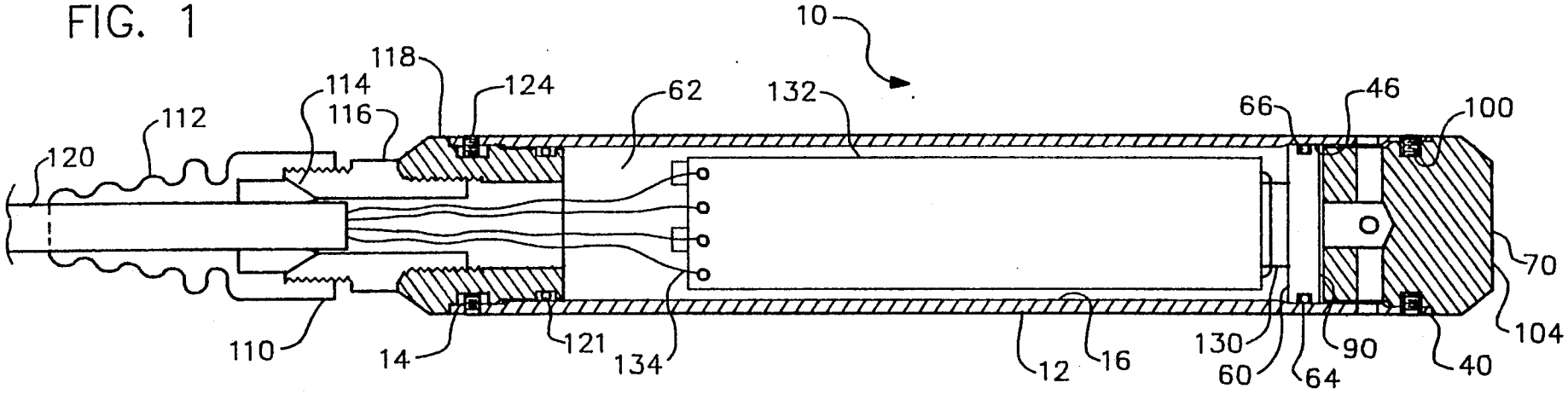
FIG. 1 is a sectional view of the present invention.
Figure 2:
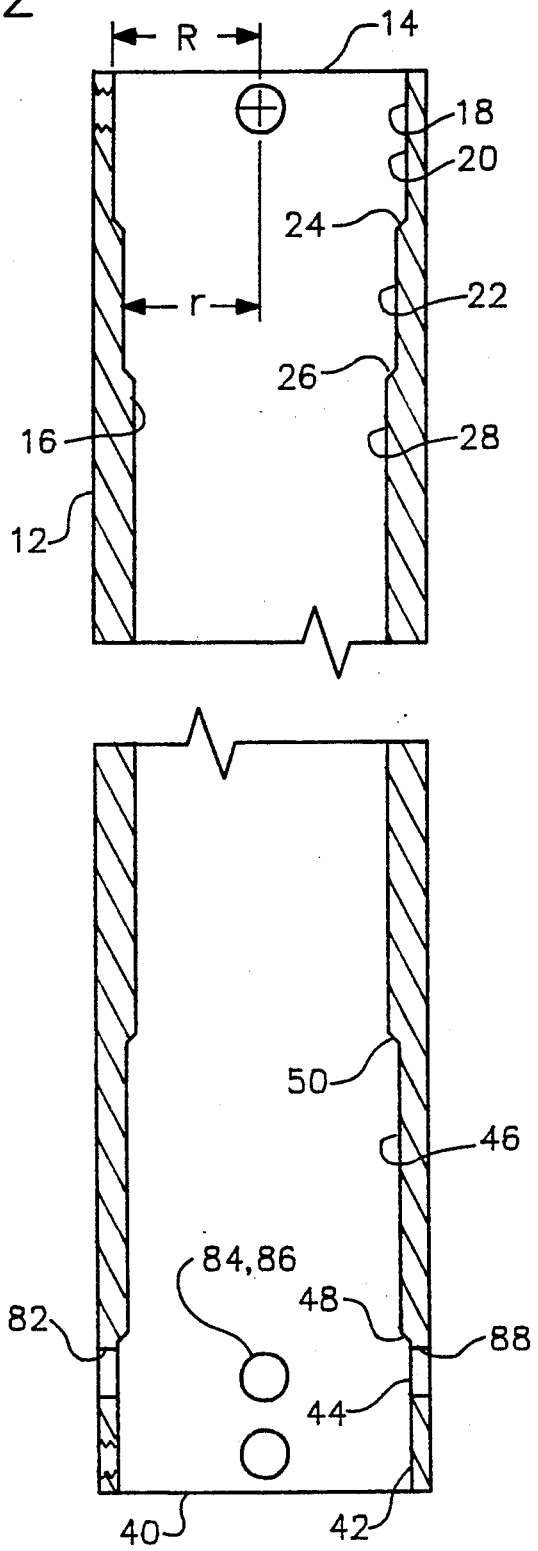
FIG. 2 is a sectional view of the body of the sensor.

In FIGS. 1 through 4 of those drawings a submersible sensor constructed in accordance with the teachings of the present invention is illustrated and generally designated by the number 10. The sensor includes a thin walled elongated cylindrical body 12 which houses the sensing devices and the signal conditioning electronics. Referring to FIG. 2, it can be seen that in the vicinity of upper end 14 of the body, inner wall 16 has been machined to form a stepped counterbore 18. The counterbore includes outer step 20, inner step 22 and chamferred section 24 which forms a transition between the outer and inner steps. As shown, the inner step has a smaller radius "r" than radius "R" of the outer step. A second chamferred section 26 is formed between inner step 22 and constant diameter section 28 of the inner wall.

Similarly, the inner wall of the body in the vicinity of lower end 40 has been machined to form stepped counterbore 42. That counterbore includes outer step 44, inner step 46 and transition sections 48 and 50.

For simplicity, the preferred embodiment illustrated is intended to sense only one physical property of well water, pressure. The sensing of pressure is accomplished by a pressure transducer 60 which has a cylindrical housing adapted to be slideably inserted into inner step 46 of counterbore 42. In order to prevent water from entering the central chamber 62 of the body from the lower end of the sensor, o-ring seal 64 is positioned in recess 66 of the transducer housing and is compressed between the recess and inner step 46.

Figure 4:
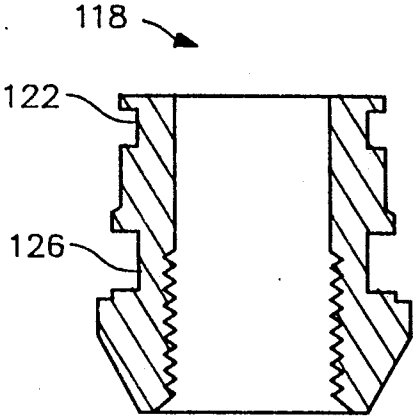
FIG. 4 is a sectional view of the end cone.
Figure 3:
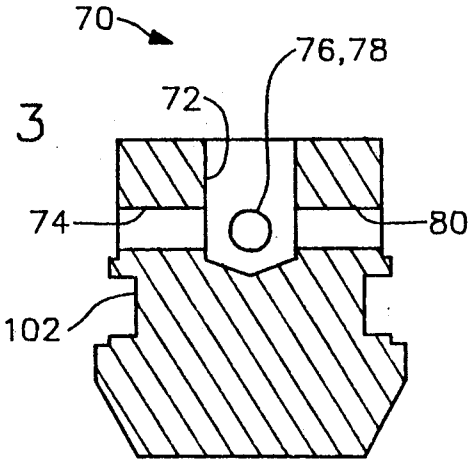
FIG. 3 is a sectional view of the end plug.

As shown in FIG. 1, pressure transducer 60 is positioned between transition section 50 and end plug 70, which is adapted to be installed in the lower end of the body. Referring to FIG. 4 it can be seen that the end plug includes bore 72 and fluid entrances 74, 76, 78 and 80, each of which is in communication with bore 72. When installed in the body, end plug 70 is positioned such that the fluid entrances are aligned with inlets 82, 84, 86 and 88, respectively, located in the body. Accordingly the inlets, fluid entrances and bore 72 provide communication between the fluid surrounding the body and pressure sensing surface 90 of the transducer. The purpose of locating the water inlets on the side of the body is to minimize the possibility that they will become clogged by silt and debris when the sensor is positioned near or in contact with the bottom of the well. The end plug is retained in the body by four set screws (such as set screw 100) which are threaded through the body and seat in recess 102.

Positioned at the upper end of the body is end cone assembly 110 which includes cable boot 112, primary wire seal 114, adapter 116 and cone end 118. The purpose of the assembly is to seal the upper end of the body and provide a water tight entrance for multiconductor service cable 120. O-ring seal 121, which is positioned in groove 122, is compressed between that groove and inner step 22 of counter bore 18. Four set screws similar to set screw 124 are threaded through the body and seat in set screw groove 126 to retain the cone end in the body. Details of the cone end are shown in FIG. 4.

In operation, the pressure of the well water near the lower end of the sensor impinges upon pressure sensing surface 90 of transducer 60, generating responsive electrical signals. Those electrical signals are transmitted through circular circuit board 130 to signal conditioning circuit board 132 which is disposed within the sealed chamber of the body. Also connected to board 132 are a plurality of conductors such as conductor 134 which emanate from service cable 120. Cable 120 transmits power from a power source (not shown) and returns processed signals from the transducer to reading and recording instrumentation (also not shown) located above ground. Details of the transducer, circuit boards 130 and 132, and service cable 120 are well known to those of ordinary skill in the art and are not discussed in detail herein.

One significant aspect of this invention is the sealing means employed between the inner chamber of the body and the cone and plug ends. As previously described, each end of the sensor body has been machined to form a stepped counterbore in which the steps are joined by a chamferred transition surface. The purpose of this design is to eliminate damage or "nicking" of the o-ring seal when the cone end and transducer are installed in the body. Referring to the upper end of the body, outer step 20, o-ring seal 121 and groove 122 are dimensioned such that when the o-ring is installed in the recess, the outer diameter of the o-ring is slightly less than the diameter of outer step 20. Accordingly, when the cone end is inserted into the upper end of the body the o-ring will pass into the outer step and by the tapped set screw bores without being damaged. As the cone end is further inserted, the o-ring will pass over chamferred section 24 and onto inner step 22, being compressed as it does so. Preferably the chamferred section is polished following machining to further avoid possible damage to the o-ring.

The primary advantage of this design is that it permits the use of a cone end which can be installed in and secured to the body without being rotated with respect to the body. Such rotation, as would typically be required by a threaded connection, is undesirable because it causes a twisting of the circuit conductors. It is apparent that this design significantly facilitates assembly and disassembly of the sensor and provides a reliable seal of the internal body chamber. A similar result is achieved by cooperation of stepped counterbore 42, o-ring seal 64 and recess 66 at the bottom end of the sensor body.

A second significant aspect of this invention is that the cone end and plug end are designed to be interchangeable. In some testing environments it may be desirable to provide a fluid inlet to the transducer in the bottom of the sensor. Such an inlet can be provided by simply substituting a second cone end for the plug end. Such a substitution also allows direct access to the transducer for calibration purposes. In order to provide such interchangeability the diameters of the inner and outer steps of the counterbores at either end of the body are substantially identical, as are the dimensions of the o-rings and cooperating portions of the cone and plug ends.

Thus it can be seen that the present invention provides for an improved submersible sensor for use in sensing the physical properties of well water or other fluids which incorporates many novel features and offers significant advantages over the prior art. Although only one embodiment of this invention has been illustrated and described, it is to be understood that obvious modifications can be made of it without departing from the true scope and spirit of this invention.

I claim:

1. A submersible sensor for use in monitoring the physical properties of well water or other fluids comprising:

a cylindrical body having a chamber therein and a cylindrical entrance providing access to the chamber, the entrance having a stepped counterbore forming outer and inner steps, the inner step having a radius less than the radius of the outer step;

sensing means disposed within the chamber for sensing one or more physical properties of the fluid; and means for sealing the entrance including a cone end adapted to be inserted in the entrance and a seal disposed between the cone end and the inner step.

2. The sensor of claim 1 wherein the entrance further includes a transition section disposed between the inner and outer steps.

3. The sensor of claim 2 wherein the transition section is chamferred.

4. The sensor of claim 1 wherein the cone end is adapted to be slideably inserted in the entrance.

5. The sensor of claim 4 further including means for retaining the cone end in the body comprising a set screw threadably engaging the body and passing through the outer step, the set screw cooperating with a recess in the cone end.

6. The sensor of claim 1 wherein the seal is an o-ring.

7. A submersible sensor for use in monitoring the physical properties of well water or other fluids comprising:

a cylindrical body having a cavity therein and first and second cylindrical entrances providing access to the cavity, each entrance having a stepped counterbore associated therewith and including inner and outer steps, the inner step having a radius less than the radius of the outer step;

sensing means disposed within the cavity for sensing one or more physical properties of the fluid; and means for sealing the first entrance including a cone end inserted in the associated counterbore and a seal disposed between the associated inner step and the cone end, the cone end and seal also being adapted to be inserted in and to seal the second entrance.

8. The sensor of claim 7 wherein the entrances are located at opposing ends of the body.

9. The sensor of claim 7 wherein the radii of the inner steps are substantially identical in diameter.

10. The sensor of claim 7 further including means for sealing the second entrance including a plug end adapted to be inserted in the counterbore associated therewith and a seal disposed between the inner step of the associated counterbore and the plug end.

11. A submersible sensor for use in monitoring the physical properties of well water or other fluids comprising:

cylindrical body having a cavity therein and first and second cylindrical entrances located at opposing ends of the body and providing access to the cavity, each entrance having a stepped counterbore associated therewith including inner and outer steps, the inner steps having substantially identical radii less than the radii of the associated outer steps;

sensing means disposed within the cavity for sensing one or more physical properties of the fluid; and means for sealing the first entrance including a cone end inserted in the associated counterbore and a seal disposed between the associated inner step and the cone end, the cone end and seal also being adapted to be inserted in and to seal the second entrance; and means for sealing the second entrance including a plug end inserted in the associated counterbore and a seal disposed between the inner step of the associated counterbore and the plug end.

* * * * *